US007048153B2

(12) United States Patent
Gentile

(10) Patent No.: US 7,048,153 B2
(45) Date of Patent: May 23, 2006

(54) FOAM DISPENSING ARTICLE

(75) Inventor: James Louis Gentile, Orange, CT (US)

(73) Assignee: Unilever Home & Personal Care USA, Division of Conopco, Inc., Greenwich, CT (US)

( * ) Notice: Subject to any disclaimer, the term of this patent is extended or adjusted under 35 U.S.C. 154(b) by 299 days.

(21) Appl. No.: 10/671,288

(22) Filed: Sep. 25, 2003

(65) Prior Publication Data

US 2005/0067435 A1 Mar. 31, 2005

(51) Int. Cl.
*B67D 5/58* (2006.01)

(52) U.S. Cl. ..... 222/190; 222/321.9; 222/145.6

(58) Field of Classification Search ..... 222/190, 222/145.6, 145.5, 192, 321.1, 385, 321.2, 222/321.4, 321.7, 321.9, 481.5, 383.1, 380
See application file for complete search history.

(56) References Cited

U.S. PATENT DOCUMENTS

| | | | | | |
|---|---|---|---|---|---|
| 2,515,328 | A | * | 7/1950 | Bobrick | 222/190 |
| 3,709,437 | A | | 1/1973 | Wright | |
| 3,779,464 | A | * | 12/1973 | Malone | 239/350 |
| 3,937,364 | A | | 2/1976 | Wright | |
| 4,022,351 | A | | 5/1977 | Wright | |
| 4,184,615 | A | | 1/1980 | Wright | |
| 4,274,560 | A | * | 6/1981 | Cater | 222/321.2 |
| 4,615,465 | A | * | 10/1986 | Grothoff | 222/1 |
| 4,735,347 | A | * | 4/1988 | Schultz et al. | 222/321.2 |
| 4,895,279 | A | * | 1/1990 | Schultz | 222/321.2 |
| 4,964,544 | A | * | 10/1990 | Hanna et al. | 222/181.2 |
| 5,220,483 | A | | 6/1993 | Scott | |
| 5,337,929 | A | | 8/1994 | van der Heijden | |
| 5,364,031 | A | | 11/1994 | Taniguchi et al. | |
| 5,443,569 | A | * | 8/1995 | Uehira et al. | 222/190 |
| 5,782,621 | A | * | 7/1998 | Harris | 417/470 |
| 5,881,956 | A | * | 3/1999 | Cohen et al. | 239/333 |
| 5,918,771 | A | * | 7/1999 | van der Heijden | 222/136 |
| 6,030,931 | A | | 2/2000 | Vinski et al. | |
| 6,206,303 | B1 | * | 3/2001 | Shinozaki et al. | 239/333 |
| 6,264,964 | B1 | | 7/2001 | Mohammadi | |
| 6,536,629 | B1 | * | 3/2003 | van der Heijden | 222/190 |
| 6,612,468 | B1 | * | 9/2003 | Pritchett et al. | 222/190 |
| 6,779,689 | B1 | * | 8/2004 | Flaig et al. | 222/182 |

FOREIGN PATENT DOCUMENTS

| | | |
|---|---|---|
| WO | 97/13585 | 4/1997 |

* cited by examiner

*Primary Examiner*—Frederick Nicolas
(74) *Attorney, Agent, or Firm*—Milton L. Honig

(57) ABSTRACT

A foam dispensing article is provided which includes a reservoir for receiving a liquid product and an operating unit for dispensing foam as an air-liquid mixture. The unit includes an air pump, a liquid pump concentrically surrounded at least partially by the air pump, an operating component positioned above the pumps containing a foam forming screen device, and a spring system. The spring system functions to return pistons of the air and liquid pumps to an unactivated position and includes an inner spring positioned internally concentric to the air piston. The improvement of the present invention is characterized in the spring device having a return force greater than 4 lbs. (17.8 N). In one embodiment, the spring device includes both an outer spring conically tapered and surrounding an inner spring. The outer spring provides the required force in excess of 4 lbs. (17.8 N). Less liquid drip and piston stickage is achieved with the improvement to the spring system.

8 Claims, 3 Drawing Sheets

FOAM DISPENSING ARTICLE

BACKGROUND OF THE INVENTION

1. Field of the Invention

The invention concerns a foam dispensing article based on a non-aerosol mechanical pump.

2. The Related Art

Foamed compositions are useful in a variety of consumer products. These include compositions intended to clean hard surfaces in households and treating human skin and hair. Illustrative compositions are shampoos, body and hair mousse, shaving creams and hand cleansers.

Non-aerosol devices can generate foam by mixing a foamable liquid with air. A variety of pump devices have been on the market for several years. U.S. Pat. No. 5,337,929, U.S. Pat. No. 5,220,483 B1 and WO 97/13585 all assigned to Airspray International B.V. describe mechanical pump variants which rely upon a chamber for mixing air with a liquid component to express a mousse. Airspray International has provided these devices for delivery of compositions in many commercial products. Some of these are represented by the skin and hair technology disclosed in U.S. Pat. No. 6,030,931 (Vinski et al.) and U.S. Pat. No. 6,264,964 B1 (Mohammadi).

Related mechanical pumps are reported in U.S. Pat. No. 5,364,031 (Taniguchi et al.) wherein nozzles are reported with velocity decreasing structures to achieve thick homogeneous foams. Other related pump configurations are found in U.S. Pat. No. 3,709,437, U.S. Pat. No. 3,937,364, U.S. Pat. No. 4,022,351 and U.S. Pat. No. 4,184,615 all to Wright.

I have found certain shortcomings in the commercially available mechanical pump devices when they are applied for delivering compositions containing surfactants. Unwittingly consumers operate pumps of the aforementioned type in a manner causing various problems. Slow downward pressure on the actuator head increases chances of a slow return for valve closure of the liquid product containment chamber. A tilt of the package then allows liquid to enter the pump vent hole. Once within the air chamber, some liquid product will be trapped. There are two consequences. Lubrication oil on the piston can be solubilized within the liquid product. This causes the piston to stick. Secondly, liquid product absent aeration can dribble from the mouth of the exit nozzle rather than being expressed as a foam.

Accordingly, it would be desirable to have an improved mechanical foam pump system that avoids the sticking of pistons and expression of non-aerated liquid product.

SUMMARY OF THE INVENTION

A foam dispensing article is described which includes:

a reservoir for receiving a liquid product, the reservoir having a closed and an open end;

an operating unit for dispensing the foam as an air-liquid mixture at least partially positioned over the reservoir and the open end, the unit including:

an air pump including an air piston slidably movable within an air cylinder;

a liquid pump concentrically surrounded at least partially by the air pump including a liquid cylinder and a piston slidably movable within the liquid cylinder;

an operating component positioned at least partially above the liquid and air pumps, the component including a foam forming screen device, a product outflow channel downstream and receiving foamed liquid from the screen device, the operating component by hand pressure being downwardly movable toward the reservoir thereby forcing the pistons to pump air and liquid product through the screen device;

a spring system functioning to return both air and liquid pump pistons upward to an unactivated position, the system comprising an inner spring positioned internally concentric to the air piston; and wherein the improvement is characterized in the spring device having a return force of greater than 4 pounds (17.8 N).

BRIEF DESCRIPTION OF THE DRAWING

Further features and advantages of the present invention are described in the accompany drawing in which.

DETAILED DESCRIPTION OF THE INVENTION

Figure 1:
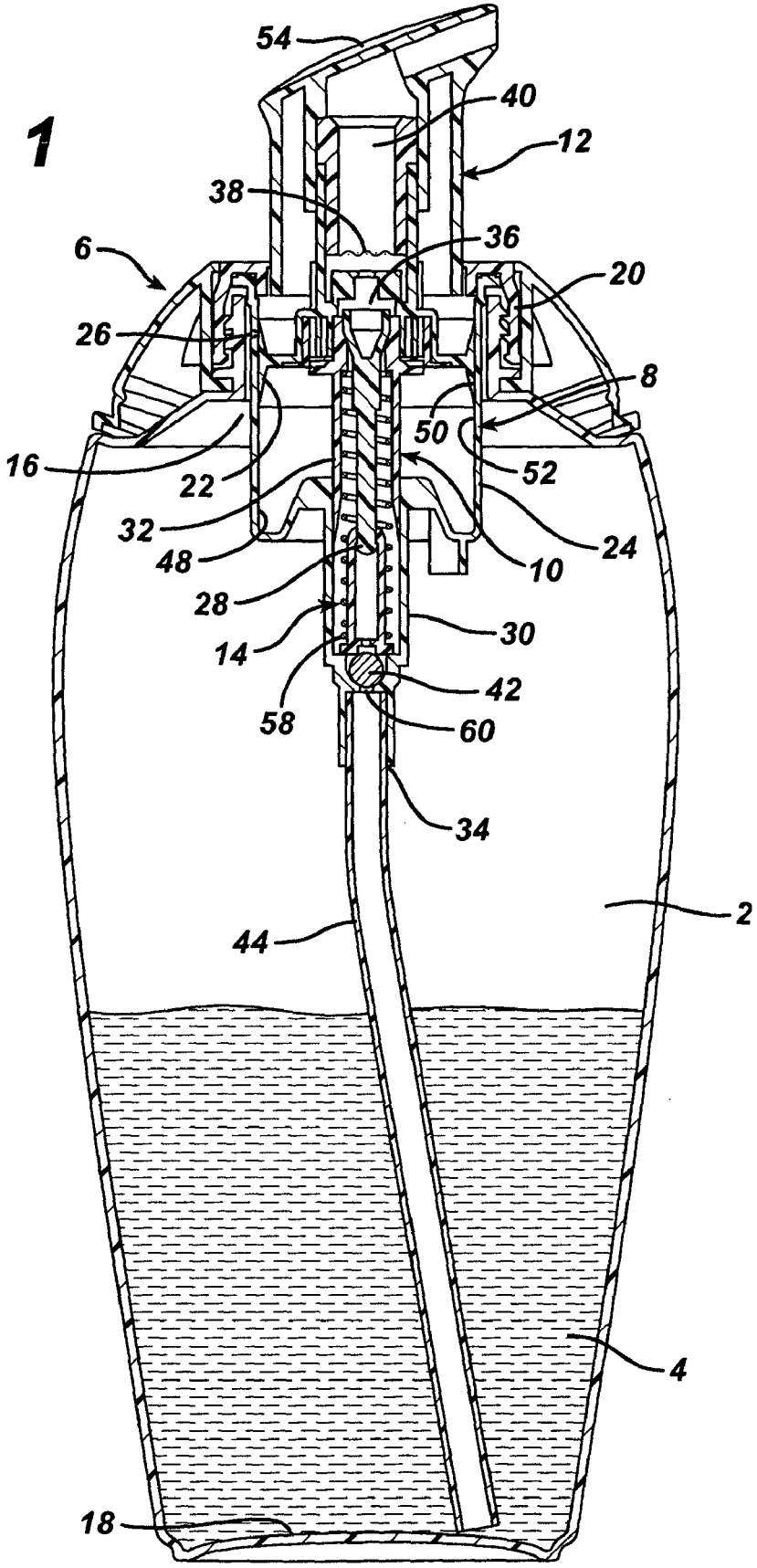
FIG. 1 illustrates in cross-section a first embodiment of a foam dispensing article in an unactivated first position according to the present invention.

Problems have been recognized with standard mechanical foam generating pumps such as those available from the Airspray Company. These types of pumps have pistons which tend to stick and often cause liquid products to drip because liquid can bypass a stuck piston without being aerated. Now it has been found that a non-stick return action can be improved by a spring system having a return force greater than 4 lbs. (17.8 N). Preferably the return force best ranges between 5.5 and 7 lbs. (24.4 N and 31.1 N, respectively).

Two approaches are preferred to improve the spring system functioning. In a first approach, an inner spring held inside a cylinder of the liquid pump can be strengthened to the desired greater than 4 lbs. (17.8 N). The improved result can be achieved with either a larger gauge wire, use of a more forceful wire material or an increase in the number of coils over that of the commercially available spring found in typical pumps. Alternatively, a second outer spring lodged within a cylinder of the air pump concentrically surrounding the liquid pump cylinder can achieve the required return force. In this embodiment, the inner spring can have a force of 4 lbs. (17.8 N) or less, with the outer spring contributing all the return force of above 4 lbs. (17.8 N). For instance, the outer spring could provide all of the return upstroke force of 5 lbs. (22.2N) and the inner spring at 3 lbs. (13.3N) would merely operate on the poppet of the check valve.

The foam dispensing article of the present invention includes a reservoir 2 for receiving a liquid product 4 and an operating unit 6 for dispensing the liquid product as a foam. The unit includes an air pump 8, a liquid pump 10, an operating component 12 and a spring system 14.

FIG. 1 illustrates a cross-section of a first embodiment of the present invention. Operating unit 6 is positioned above reservoir 2 sealingly fitting over an open end 16 of the reservoir. Opposite the open end is a closed end 18 serving as a bottom of the reservoir. A skirt 20 threadably attaches to the mouth of the reservoir.

Located within the operating unit is the air and liquid pump. The air pump includes an air piston 22 slidably movable within an air cylinder 24, the latter including an air inlet 26.

The liquid pump 10 is at least partially concentrically surrounded by the air pump 8. The liquid pump includes a valve poppet 28, a liquid cylinder 30, a piston 32 movable within the cylinder, a liquid inlet 34 and a discharge outlet 36.

The operating component 12 is positioned at least partially above the liquid and air pumps. The component includes a foam forming screen device 38. Downstream from the screen device is an outflow channel 40 through which foamed liquid product exits the dispensing article.

Operating component 12 by application of hand pressure is downwardly movable toward the reservoir. Thereby on the downstroke pistons 22, 32 are forced to pump air and liquid product upwardly through the screen device.

A ball valve 42 is seated at the inlet 34 of the liquid pump. A siphon tube 44 draws liquid product from the bottom of the reservoir to an area directly below the ball valve.

Figure 2:
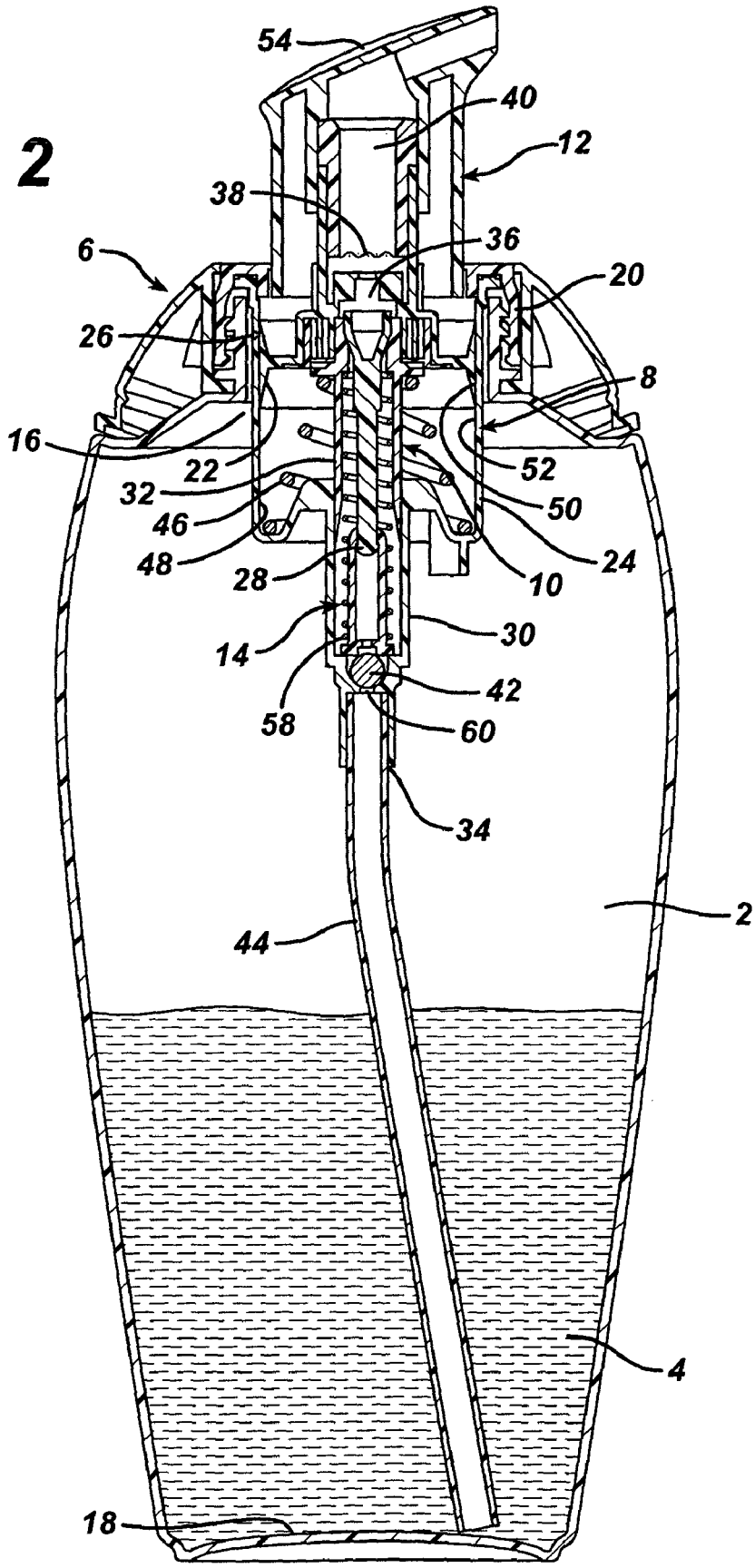
FIG. 2 illustrates in cross section a second embodiment of a foam dispensing article according to the present invention.

FIG. 2 illustrates a second embodiment of the present invention. All of the elements found in the first embodiment are also found in the second. It is for this reason that numerals are identical. The difference in the second embodiment is that it is provided with an outer spring 46 of a tapered conical configuration. The outer spring rests against walls 48 of the air cylinder and is positioned directly under air piston 22.

Lubricant in the form of a silicone oil is held in an area 50 between an inner wall 52 of the air cylinder and outer skirt wall of the air piston.

Figure 3:
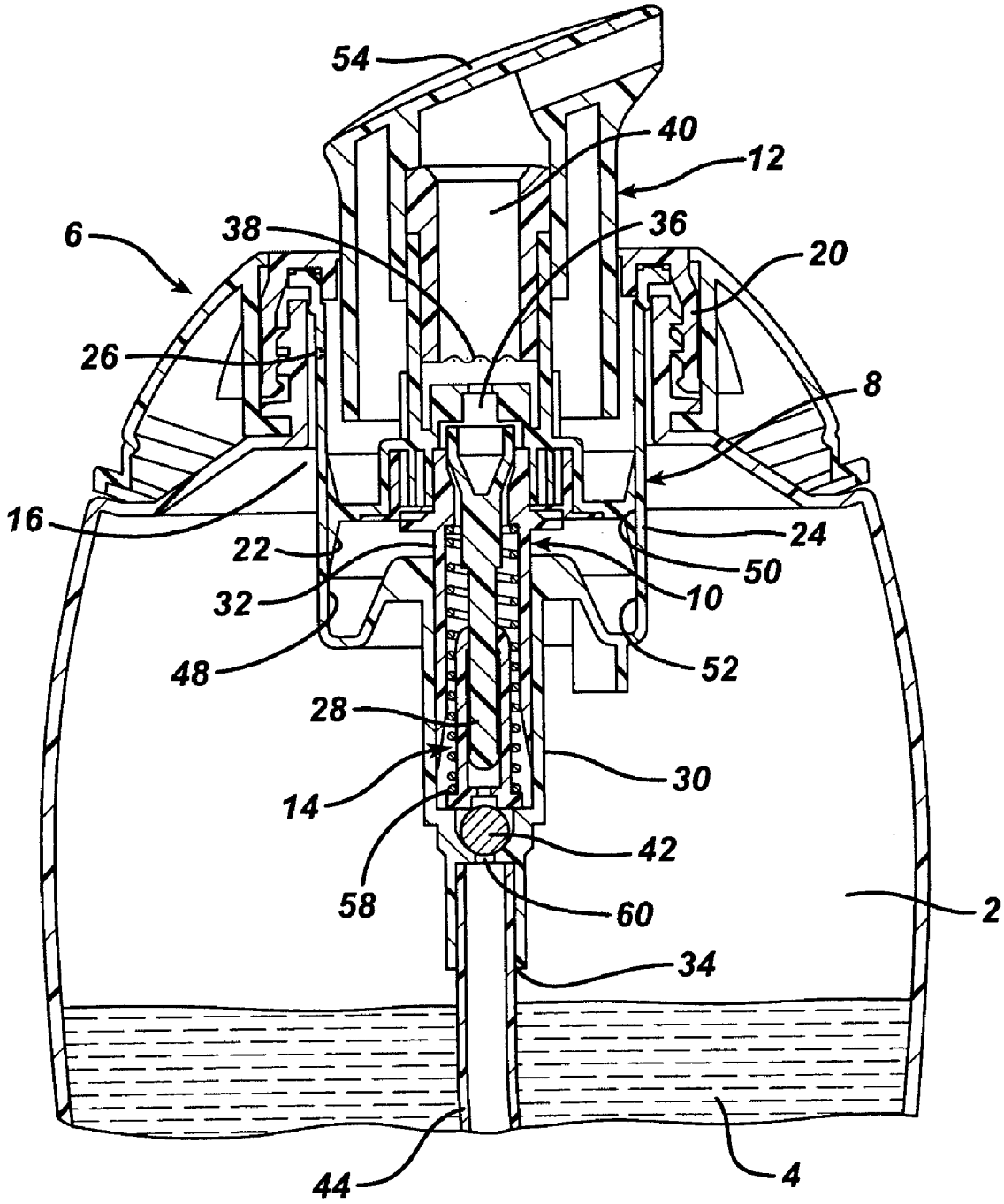
FIG. 3 illustrates in enlarged cross-section the article of FIG. 1 in an activated second position according to the present invention.

Operation of the dispensing article occurs in the following manner. Downward pressure is applied against nozzle head 54. As shown in FIG. 3, this movement forces the liquid piston 22 to slide downward within cylinder 30 of the liquid pump 10. Concurrently compressed through the downward stroke is inner spring 58 lodged between a lower end of the air piston and a mouth 60 of the ball valve.

A suction is created by the upward movement forcing liquid product up through the syphon tube 44. It is transported through cylinder 30 and into the screen device 38. Therein the liquid product and air mix resulting in an aerated foam product which exits through nozzle head 54.

Concurrent with activation of the liquid pump, the downward pressure against the nozzle forces a downward movement of the air piston 22. The resultant compression of the air cylinder 24 forces air from the pump system through discharge outlet 36 into the screen device 38.

Once downward pressure on the nozzle is released, inner spring 58 forces a return stroke. The ball of the ball valve 42 opens allowing liquid product to be suctioned up through the syphon tube 44. Concurrently the return stroke allows air to reenter the pump system via inlet 26 and bringing the pressure above the liquid product in reservoir 2 back to atmospheric.

Liquid product 4 preferably but not necessarily is a cosmetic product such as a skin cleanser, shampoo, dentifrice or color cosmetic. Potential ingredients of these liquid products include surfactants, humectants, exfoliants, conditioning agents, preservatives, fragrances and thickeners. The surfactant can either be anionic, nonionic, cationic, zwitterionic, amphoteric or mixtures thereof. The amount of surfactant may range anywhere from about 0.1 to about 30%, preferably from about 1 to about 15% by weight of the liquid product. Illustrative nonionic surfactants are alkoxylated $C_{10}$–$C_{22}$ fatty alcohols or acids or sorbitan. Other suitable nonionics include polyoxypropylene-polyoxyethylene materials and alkyl polyglycosides. Anionic type surfactants include fatty acids soaps, sodium lauryl sulphate, sodium lauryl ether sulphate, alkyl benzene sulphonate, mono- and di-alkyl acid phosphates, sarcosinates, taurates and sodium fatty acyl isethionate. Amphoteric surfactants include such materials as dialkyl amine oxide and various betaines (such as cocamidopropyl betaine).

Except in the operating and comparative examples, or where otherwise explicitly indicated, all numbers in this description indicating amounts of material ought to be understood as modified by the word "about".

The term "comprising" is meant not to be limiting to any subsequently stated elements but rather to encompass non-specified elements of major or minor functional importance. In other words the listed steps, elements or options need not be exhaustive. Whenever the words "including" or "having" are used, these terms are meant to be equivalent to "comprising" as defined above.

EXAMPLE

A study was conducted to evaluate the problem of inadequate piston return and pistons becoming stuck in a downward stroke position. A commercial Airspray foamer pump model M3-S10 was utilized in the study. The liquid product employed comprised glycerin, decyl glucoside, sodium olefin sulfonate, cocoamidopropyl betaine, sodium lauroamphoacetate, water and a variety of minor ingredients. This product is marketed as Dove® Essential Nutrients in a 200 ml package size.

The test method for measuring the spring return force involved the following procedure. The M3-S10 pump not previously primed with any liquid product was disassembled by removing the nozzle head 54, rounded shield protecting operating unit 6, and closure/collar skirt 20 to expose the flat top of the flat top section of the air piston 22. The pump was placed into a 200 ml capacity bottle with a 33 mm neck as support during compression testing. This set-up was placed in a Chatillion TCD-200 series digital compression gauge. The set-up was placed upright in a lower platen of the gauge centering the pump and exposed piston under a compression tip of the gauge. The tip was adjusted to meet the top of the piston assembly just short of any compression. The compression gauge was then set at a zero point. Maximum spring force on the assembled pump was then read by actuating downward travel of the compression stand to achieve the 0.435 inch maximum depression of the pump. Spring force was then recorded at the 0.435 inch travel position.

Three different spring force size samples were subjected to evaluation in the model M3-S10 pump with product. Each of the evaluations were conducted in a severe operating manner. Sample pumps were purposefully inverted during the pumping action. This ensured that liquid product would flow from the vent (air inlet 26) into the air cylinder thereby dissolving piston lubricant. Thereafter the pumps were returned to the up-right position to evaluate for piston stickage. The Table below outlines the test parameters and results.

| Spring Return Force Lb. (Newton) | Change in Force From Current Model M3-S10 | Observations |
|---|---|---|
| 3 lbs. (13.3 N) | Control (0) | Piston stickage |
| 4 lbs. (17.8 N) | 1 lb. (4.45 N) | Piston stickage |

-continued

| Spring Return Force Lb. (Newton) | Change in Force From Current Model M3-S10 | Observations |
|---|---|---|
| 5 lbs. (22.2 N) | 2 lbs. (8.9 N) | No piston stickage |
| 5.3 lbs. (23.6 N) | 2.3 lbs. (10.2 N) | No piston sitckage |

A still further experiment was conducted to evaluate effectiveness of an alternative embodiment. This is shown in FIG. 2 where an outer spring is added to the spring system. The outer spring had a spring return force of 5 lbs. (22.2 N). No piston stickage was observed with this modified M3-S10 pump.

The aforementioned results indicate that a minimum of about 5 lbs. (22.2 N) is necessary to avoid piston stickage.

What is claimed is:

1. A foam dispensing article comprising:

a reservoir for receiving a liquid product, the reservoir having a closed and an open end;

an operating unit for dispensing the foam as an air-liquid mixture at least partially positioned over the reservoir and the open end, the unit comprising:

an air pump comprising an air piston slideably movable within an air cylinder;

a liquid pump concentrically surrounded at least partially by the air pump comprising a liquid cylinder and a piston slideably movable within the liquid cylinder;

an operating component positioned at least partially above the liquid and air pumps, the component comprising a foam forming screen device, a product outflow channel downstream and receiving foamed liquid from the screen device, the operating component by hand pressure being downwardly movable toward the reservoir thereby forcing the pistons to pump air and liquid product through the screen device;

a spring system functioning to return both air and liquid pump pistons upward to an unactivated position, the system comprising an inner spring positioned internally concentric to the air piston; and wherein the improvement is characterized in the spring system having a return force of greater than 4 pounds (17.8 N), a lubricant being adjacent the air piston to assist movement against a wall of the air cylinder, the liquid product comprising a surfactant being present in a sufficient amount to at least partially dissolve the lubricant during repeated activation of the operating unit thereby causing the air piston to stick, and the spring system with a return force of greater than 4 pounds overcoming air piston stickage.

2. The article according to claim 1 wherein the return force ranges from 5 to 7.5 lbs. (22.2 N to 33.4 N).

3. The article according to claim 1 wherein the spring system further comprises an outer spring within the air cylinder.

4. The article according to claim 3 wherein the inner spring is at least partially positioned nearer the closed end of the reservoir than is the outer spring.

5. The article according to claim 3 wherein the outer spring is conically tapered.

6. The article according to claim 5 wherein the outer spring has a wider diameter at an end distant from the operating component.

7. The article according to claim 1 wherein the lubricant is a silicone oil or a hydrocarbon oil.

8. The article according to claim 1 further comprising a ball valve at the inlet of the liquid pump.

* * * * *